US009586246B2

(12) United States Patent
Wasserman et al.

(10) Patent No.: US 9,586,246 B2
(45) Date of Patent: Mar. 7, 2017

(54) DOWN CONVEYOR

(71) Applicant: National Machinery LLC, Tiffin, OH (US)

(72) Inventors: Stanley J. Wasserman, Fremont, OH (US); Douglas M. Hoerig, Tiffin, OH (US)

(73) Assignee: NATIONAL MACHINERY LLC, Tiffin, OH (US)

( * ) Notice: Subject to any disclaimer, the term of this patent is extended or adjusted under 35 U.S.C. 154(b) by 0 days.

(21) Appl. No.: 14/605,168

(22) Filed: Jan. 26, 2015

(65) Prior Publication Data

US 2016/0214806 A1 Jul. 28, 2016

(51) Int. Cl.

| | |
|---|---|
| ***B65G 17/12*** | (2006.01) |
| ***B65G 47/52*** | (2006.01) |
| ***B65G 47/64*** | (2006.01) |
| ***B21C 35/00*** | (2006.01) |
| ***B21K 27/00*** | (2006.01) |
| ***B21J 9/02*** | (2006.01) |

(52) U.S. Cl.

CPC ..... *B21C 35/00* (2013.01); *B21J 9/022* (2013.01); *B21K 27/00* (2013.01)

(58) Field of Classification Search

None

See application file for complete search history.

(56) References Cited

U.S. PATENT DOCUMENTS 7,325,666 B2 * 2/2008 Stengele ..... B23Q 7/04 198/346.2

FOREIGN PATENT DOCUMENTS

JP H07-21234 U 4/1995

* cited by examiner

*Primary Examiner* — Kavel Singh

(74) *Attorney, Agent, or Firm* — Pearne & Gordon LLP

(57) ABSTRACT

A progressive forming machine having a frame supporting a plurality of workstations uniformly spaced in a horizontal plane, a transfer mechanism for shifting parts from one station to another and from a last station to a discharge station, a conveyor in the frame for lowering parts from the transfer discharge station, the conveyor having individual part carriers, the conveyor being arranged to present a carrier beneath the discharge station in timed relation to the operating cycle of the machine.

8 Claims, 4 Drawing Sheets

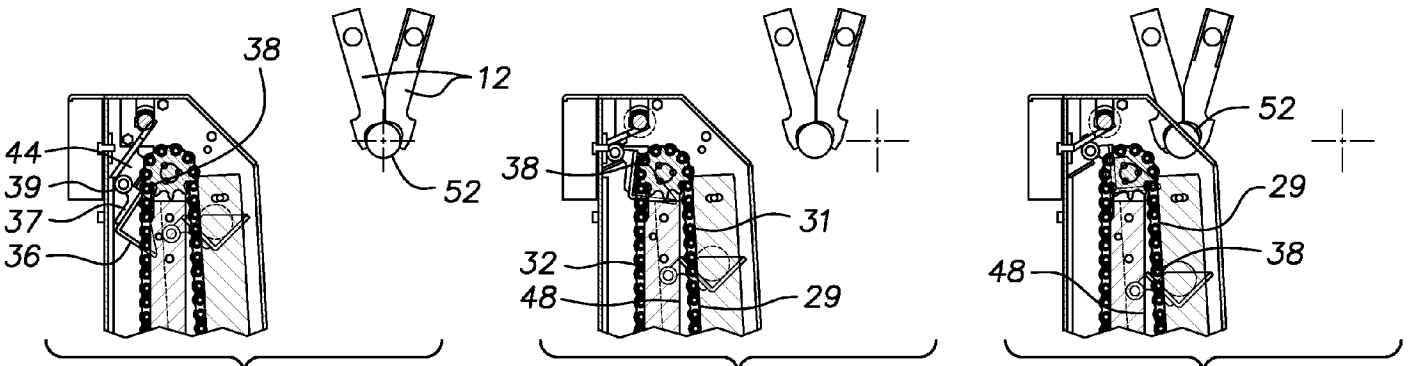
FIG. 3A
FIG. 3B
FIG. 3C
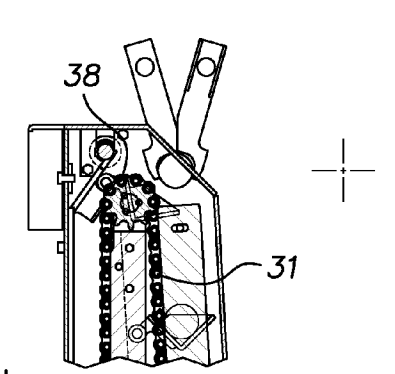
FIG. 3D
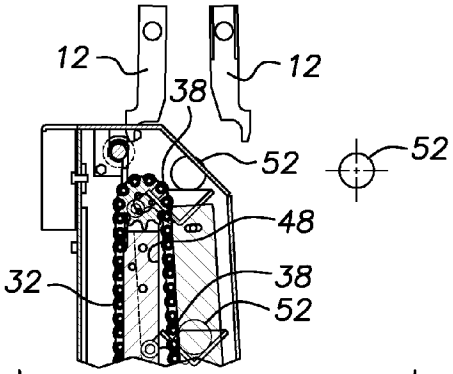
FIG. 3E
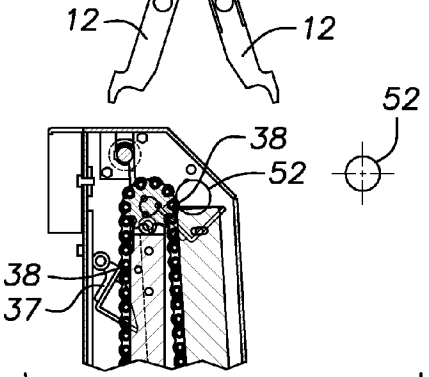
FIG. 3F

DOWN CONVEYOR

BACKGROUND OF THE INVENTION

The invention relates to a device for conveying formed parts made in a progressive forging machine from a level of the work stations to a lower level for removal from the machine.

PRIOR ART

Progressive cold forming machines typically have several workstations spaced along a horizontal plane and a valley below the plane into which scrap trimmed and punched from a workpiece falls for collection to a gravity chute. The finish formed workpiece or part also is customarily dropped into the valley area from a discharge position of a part transfer mechanism. Formed parts can be damaged in the machine when a part freefalls from the transfer discharge and strikes a preceding part or the rigid gravity discharge chute itself. The potential for damage to a formed part involves many factors including its configuration, mass, and hardness.

One attempt to avoid the risk of damage from parts dropping on one another has been to convey them individually along a horizontal path just below the workstation plane. This arrangement has the disadvantage of obstructing the tool area by eliminating a convenient platform height that an operator could otherwise stand on. Moreover, this approach can require a hole to be provided in the sidewall of the machine frame or bed, thereby weakening the sidewall.

SUMMARY OF THE INVENTION

The invention provides a generally vertically oriented conveyor in the interior of a forming machine. The conveyor receives individual finish formed parts at a transfer discharge point and lowers the part at a controlled rate of descent thereby preventing collision damage between parts in a discharge path from the machine.

The disclosed conveyor includes a pair of endless chains that vertically transport carriers that in the illustrated case are of a pan-like configuration. At one stretch or side, the chains move the carriers from the transfer area to a lower elevation within the machine where the parts are discharged at a low freefall velocity thereby eliminating or reducing a risk of damage from impacts with other finish form parts of the rigid gravity discharge chute.

The invention, by enabling the parts to be mechanically lowered within the machine, avoids obstruction of an area adjacent the plane of the workstations used by an operator to service the machine. Moreover, the inventive conveyor does not require a modification of the machine frame which could compromise its rigidity and/or strength.

BRIEF DESCRIPTION OF THE DRAWINGS

FIGS. 3A-3F are successive diagrammatic views of a carrier as it moves laterally under and then downwardly under an outboard discharge position of the fingers of a transfer mechanism.

DESCRIPTION OF THE PREFERRED EMBODIMENT

Figure 1:
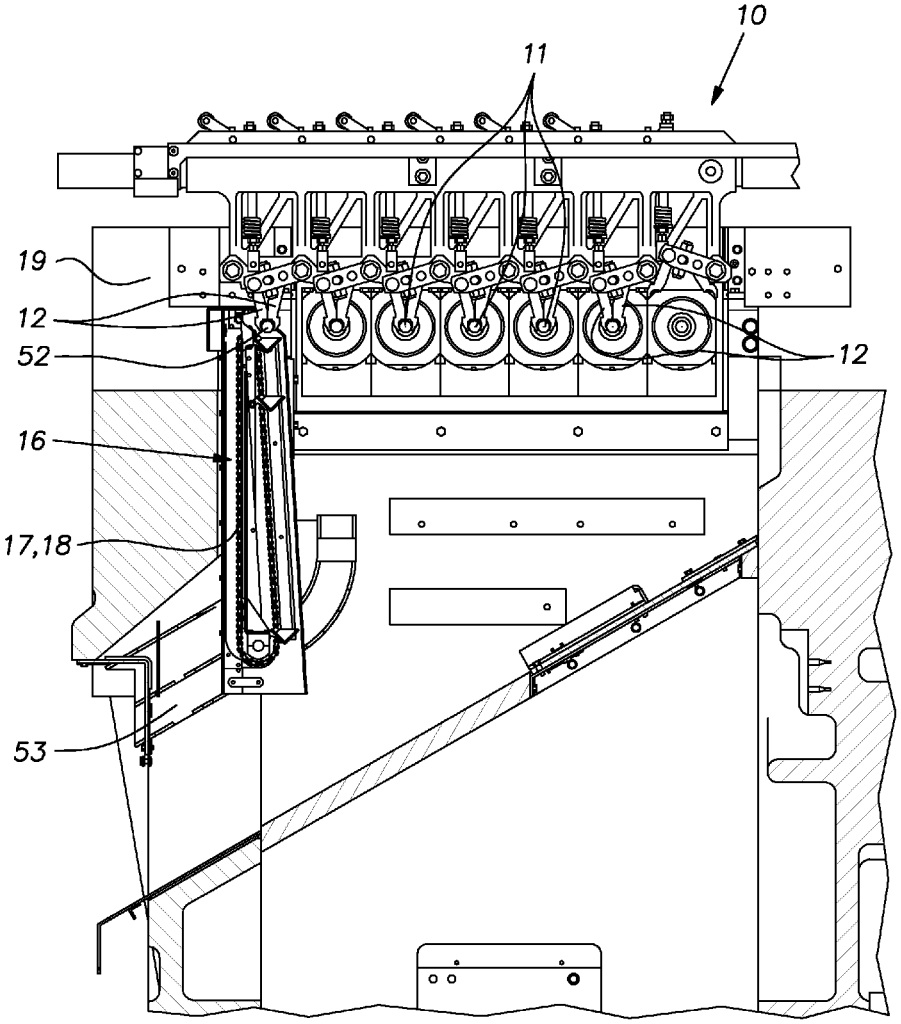
FIG. 1 is a cross-sectional elevational view of a progressive former within which is mounted a down conveyor of the invention.
Figure 2:
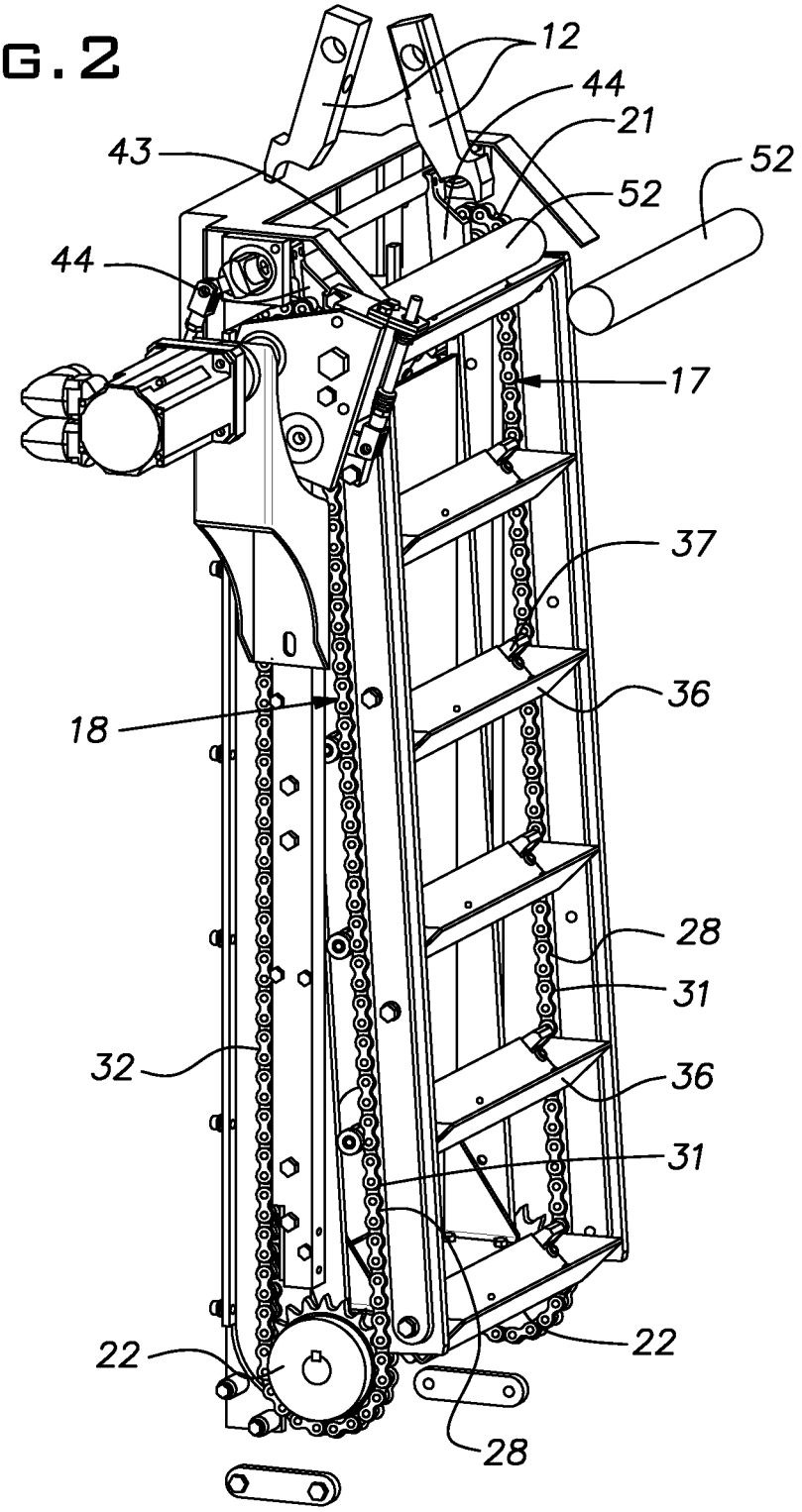
FIG. 2 is a diagrammatic perspective view of the down conveyor taken from the down side.

FIG. 1 illustrates the cross-sectional profile of a multi-station progressive cold forming machine 10. As is customary, metal parts or workpieces are progressively transferred to successive workstations 11 after being worked by opposed tools at preceding stations. Typically, this movement of the workpieces is accomplished with a transfer mechanism having depending fingers 12. The transfer fingers 12 grip a workpiece at a workstation 11 and in timed relation to the operation of the machine 10 shifts it to the next succeeding workstation 11.

A conveyor 16 includes two endless roller chain loops 17, 18. One chain 17 is in a vertical plane adjacent the transfer fingers 12 and a bolster 19 while the other chain 18 is displaced from the bolster. The chains 17, 18 are trained over respective upper and lower sprockets or wheels 21, 22. An outboard upper sprocket 21 is fixed on a drive shaft 23 rotatably supported in bearings mounted in a conveyor frame 24. The lower sprockets 22 are fixed on a common shaft 25 rotatably supported in a lower part of the frame 24. The outboard upper sprocket 21 drives the co-axial inboard upper sprocket 21 through the chain 18, shaft 25 and chain 17. Guide plates 28, 29 engage rollers of the chain 17, 18 and constrain the respective stretches 31, 32 of the chains 17, 18 to generally vertical, straight lines. The guide plates 28 for the down stretch 31 of the chains 17, 18 is slightly out of plumb to provide adequate clearance for the motion of carriers 36 pivotally fixed to the chains 17, 18.

The carriers 36 are shallow pan-like structures that, for example, can have a V-shaped cross-section. The carriers or buckets 36 are shorter than the spacing between the chains 17, 18 so that, as will be understood, the carriers can swing between the chains. At each end, a carrier 36 is pivotally connected to a chain through a rigid bracket 37 of T-shaped profile. The bracket 37 is pivotally fixed to a pin of a chain 17, 18 at 38. A distal part of the bracket 37 is straddled by a pair of rollers 39. As discussed below, the rollers 39 serve like cam followers to maintain a desired orientation of the carriers 36. In the various illustrated views, the sprockets 21, 22 turn clockwise; the carriers 36 on the downward chain stretch 31 are concave upward and the carriers on the upward stretch 32 hang downwardly.

Figure 4:
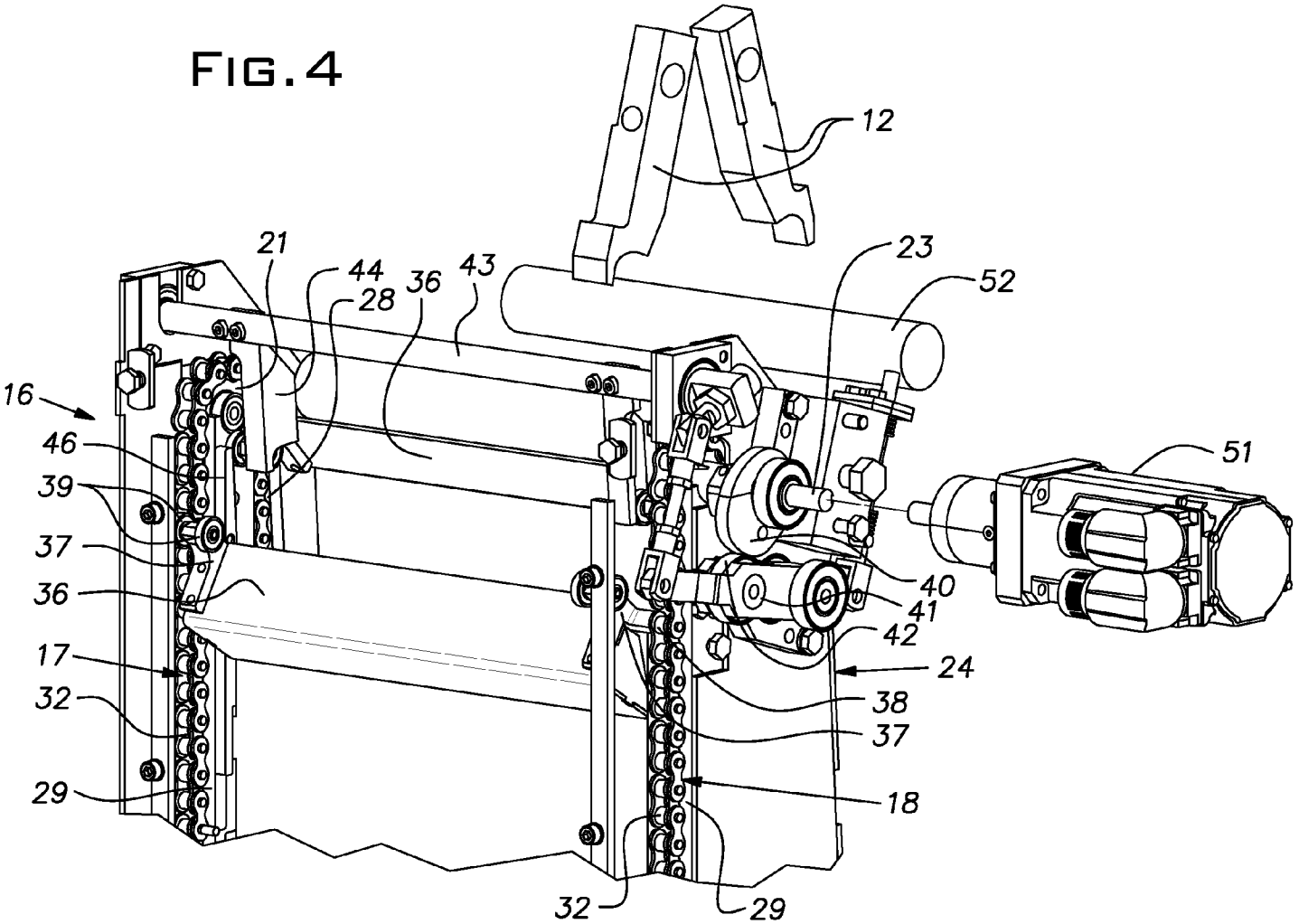
FIG. 4 is a diagrammatic perspective view of an upper end of the down conveyor taken from the up-side.

FIGS. 3A-3F illustrate a transition of a carrier 36 from a hang-down position to a concave upward position, hereafter sometimes called a carrying position. A preliminary scan of these views illustrate that a carrier 36 pivots from the hang-down position through a space between the chains 17, 18. These kinematics are produced by a cam 40 (FIG. 4) fixed on the drive shaft 23 and driving a lever 41 through a cam follower 42. The lever 41 oscillates a shaft 43 parallel to the sprocket drive shaft 23. The shaft 43, in turn, pivotally rocks or oscillates a pair of channels 44, one adjacent each of the chains 17, 18. The interior of the channels 44 is sized to receive a roller 39 associated with a carrier 36. As noted, the brackets 37 provide a pivot connection 38 between a carrier 36 and a chain 17, 18.

As a carrier 36 rises on the left chain stretch 32, it is led by its associated rollers 39 (FIG. 3A). A roller bears against a vertical track plate 46 (FIG. 4) until it is received in an associated channel 44. The pitch diameter of the upper sprockets 21 is equal to the spacing of the carrier pivots 38. The cam 40 is configured and timed to swing the channels 44 into the paths of the rollers 39 as the rollers approach the top of the plate 46. As the sprockets 21 continue to rotate, the cam 40 causes the channels 44 to slow the rise of the rollers 39 relative to the chains 17, 18 thereby pivoting a carrier toward its carrying position (FIGS. 3B-3D).

As the pivot center 38 on a chain 17, 18 starts to descend (FIG. 3E), the channels 44, still being located by the cam 40, orient the carrier 36 to the carrying position. The distal end of the channels 44 align with generally vertical tracks 48 so that as the carrier 36 descends on the chain stretch 31, the rollers 39 ride on the tracks 48. The roller tracks 48 and chain tracks or guide plates 29 are parallel so that the concave up carrying orientation of a carrier 36 is maintained through the descent of the carrier until the rollers 39 run off the bottoms of the tracks 48 and the carrier is thereby released to pivot downwardly to a workpiece releasing position.

The sprocket drive shaft 23 and, therefore, the conveyor 16, is preferably operated by a servomotor (schematically illustrated at 51 in FIG. 4) synchronized with the speed and timing of the forming machine 10.

The motor 51 rotates the shaft 23 so that a carrier 36 is located directly under the transfer fingers 12 when the transfer fingers are opened. A part or workpiece held by the transfer fingers 12 drops a relatively short distance, for example, in comparison to the depth of the adjacent frame sidewall which is a measure of the distance a part would otherwise be required to fall for removal from the machine. The kinematics of the carrier 36 adjacent the upper sprockets 21 do not require the carrier to rise above the plane of the workstations 11 when it transitions between a workpiece discharging orientation to the carrying orientation. At the bottom of the tracks, the rollers 39 and, therefore, the carrier 36 are released so that the carrier can swing to its downward hanging position and softly deposit a workpiece 52 on a chute 53 (FIG. 1) or other delivery mechanism.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A progressive forming machine having a frame supporting a plurality of workstations uniformly spaced in a horizontal plane, a transfer mechanism including transfer fingers for gripping a part and for shifting parts from one station to another and from a last station to a discharge station, a conveyor in the frame for lowering parts from the transfer discharge station, the conveyor having individual part carriers, the conveyor being arranged to present a carrier directly vertically beneath the discharge station in timed relation to the operating cycle of the machine, whereby transfer fingers of the transfer mechanism directly drop a single part into an individual part carrier.

2. A conveyor for lowering formed parts in a progressive cold forming machine comprising an endless loop trained over top and bottom wheels and forming up and down stretches, a plurality of carriers uniformly spaced along the loop, the conveyor being adapted to dispose a carrier directly vertically beneath a part discharge station where a part is dropped from transfer fingers in the forging machine whereby the carrier can receive a part dropped directly from the transfer fingers at the discharge station, the conveyor having a plurality of carriers on each stretch of the loop whereby the conveyor can deliver a part to a level substantially below the discharge station at a low velocity rate in relation to the operating speed of the machine.

3. A conveyor as set forth in claim 2, wherein said carriers are pivotally mounted on said loop and a mechanism is arranged to pivot said carriers from a downward discharge orientation to an upward carrying orientation while a respective pivot connection of the carrier is adjacent the top wheel, and a lower part supporting surface of a carrier remains below a top of the top wheel.

4. A conveyor as set forth in claim 3, wherein the orientation of a carrier is controlled by the position of an associated carrier roller having a fixed relation to the carrier.

5. A conveyor as set forth in claim 3, wherein said mechanism includes a channel that guides successive carrier rollers through a path to orient a carrier to the part carrying orientation from the downward orientation as a portion of the loop associated with the carrier pivot passes over the top wheel.

6. A conveyor as set forth in claim 4, wherein two loops are provided and said carriers are disposed between said loops and are pivotally fixed to both loops.

7. A conveyor as set forth in claim 4, wherein said channel pivots about a fixed horizontal pivot axis in timed relation to the rotation of one of said wheels.

8. A progressive forming machine as set forth in claim 1, wherein the conveyor is defined in claim 2.

* * * * *